US005347737A

United States Patent [19]

Theobald, III

[11] Patent Number: 5,347,737

[45] Date of Patent: Sep. 20, 1994

[54] PORTABLE SIGN

[76] Inventor: Clarence J. Theobald, III, 2751 Graham Ave., Louisville, Ky. 40206

[21] Appl. No.: 926,504

[22] Filed: Aug. 7, 1992

[51] Int. Cl.[5] ..... G09F 15/00

[52] U.S. Cl. ..... 40/610; 40/603; 248/166

[58] Field of Search ..... 40/603, 604, 605, 610, 40/612, 212, 215, 217; 248/165, 166, 461, 462

[56] References Cited

U.S. PATENT DOCUMENTS

| | | | |
|---|---|---|---|
| 541,672 | 6/1895 | Pappin | 40/610 |
| 979,626 | 12/1910 | Wolff | 248/461 |
| 1,014,381 | 1/1912 | Force | 248/461 |
| 1,284,624 | 11/1918 | Ehrenberg | 248/166 X |
| 1,520,896 | 12/1924 | Wadsworth | 40/603 |
| 1,735,740 | 11/1929 | Elbon | 248/166 |
| 2,072,754 | 3/1937 | Jones | 40/603 |
| 2,075,401 | 3/1937 | Mosby | 40/603 |
| 2,723,817 | 11/1955 | Harwood et al. | 248/34 |
| 2,993,465 | 7/1961 | Ginsley et al. . | |
| 3,614,033 | 10/1971 | McCarty, Jr. | 40/212 X |
| 3,685,666 | 8/1972 | Rose | 40/610 X |
| 3,941,140 | 3/1976 | Beavers . | |
| 4,119,289 | 10/1978 | Kanocz | 248/166 X |
| 4,471,548 | 9/1984 | Goudie | 40/610 |
| 4,875,302 | 10/1989 | Noffsinger | 40/610 |
| 5,199,375 | 4/1993 | Johson | 40/610 X |

*Primary Examiner*—Peter R. Brown
*Assistant Examiner*—J. Bonifanti
*Attorney, Agent, or Firm*—Camoriano & Smith

[57] ABSTRACT

A portable sign includes at least three elongated members interconnected by collapsible members and can be collapsed to fit into a shipping tube.

17 Claims, 4 Drawing Sheets

PORTABLE SIGN

BACKGROUND OF THE INVENTION

The present invention relates to signs, and, in particular, to portable signs which can be moved, for example, from one sporting event to another.

Many types of portable signs are known. Most of the signs collapse down to a rectangle, which has a large surface area, making shipping difficult and expensive. These signs are also very heavy, which again makes shipping difficult, and makes set-up the signs very labor-intensive. In general, if the signs are being moved from one sporting event to another, the organization moving the signs would have to have a large truck and two or three people in order to load and unload the signs, set up and take down the signs, and to carry the signs from place to place.

Some signs and tents can be taken apart to fit into a relatively small package, but then there are numerous loose parts which have to be kept track of, which is very inconvenient. Also, these signs are generally not very sturdy and often not self-supporting, having to be connected to posts inserted into the ground and so forth. Putting holes in the ground may be acceptable in some situations, but, in many others, where the ground is paved or covered with synthetic turf, it would be completely unacceptable to put holes in the ground in order to make the sign stand up.

Most portable sign frames also do not provide a continuous flat surface all the way to the edge, which is required if sign frames are to be connected together to make a single, long sign.

SUMMARY OF THE INVENTION

The present invention provides a portable sign which is lightweight and which can be collapsed to fit into a shipping tube, so that, in the preferred embodiment, a twenty-foot sign can be shipped in a six-inch diameter shipping tube which is 5.5 feet long.

Because the sign of the present invention is lightweight and can be collapsed to a small shape, it can easily be set up and taken down by a single person.

In addition, because the sign of the present invention can be shipped in a shipping tube, it can be sent by UPS or some other common carrier, meaning that it is not even necessary to rent a truck and have a person travel with the signs in order to move the signs from one event to the other. The set-up person can fly from event to event, or a local set-up person can be used, greatly reducing labor and shipping costs.

The sign frame of the present invention provides a flat surface which is continuous all the way to the edge of the sign, meaning that several sign frames can be connected together to make a long sign.

The sign of the present invention is free-standing, and does not require putting holes in the ground.

The sign of the present invention collapses without taking it apart, meaning that problems with losing parts are avoided.

The sign of the present invention can be erected in three forms—as a horizontal sign, in which several signs can be connected together, as a vertical kiosk-type sign with all the legs parallel to each other, and as a vertical sign in the shape of a teepee, thus making a single sign structure very versatile in its applications.

DESCRIPTION OF THE PREFERRED EMBODIMENT

The preferred embodiment of the present invention is shown in FIGS. 1–13. The invention is a sign 10, which is made up of one or more sign frames 12 over which a flexible covering 14 can be draped. Most of the drawings have the flexible covering 14 removed for clarity.

Figure 2:
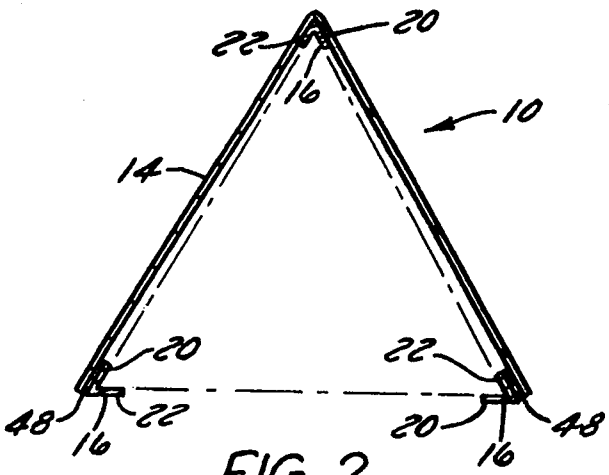
FIG. 2 is a sectional view taken through the section 2—2 of FIG. 1.
Figure 1:
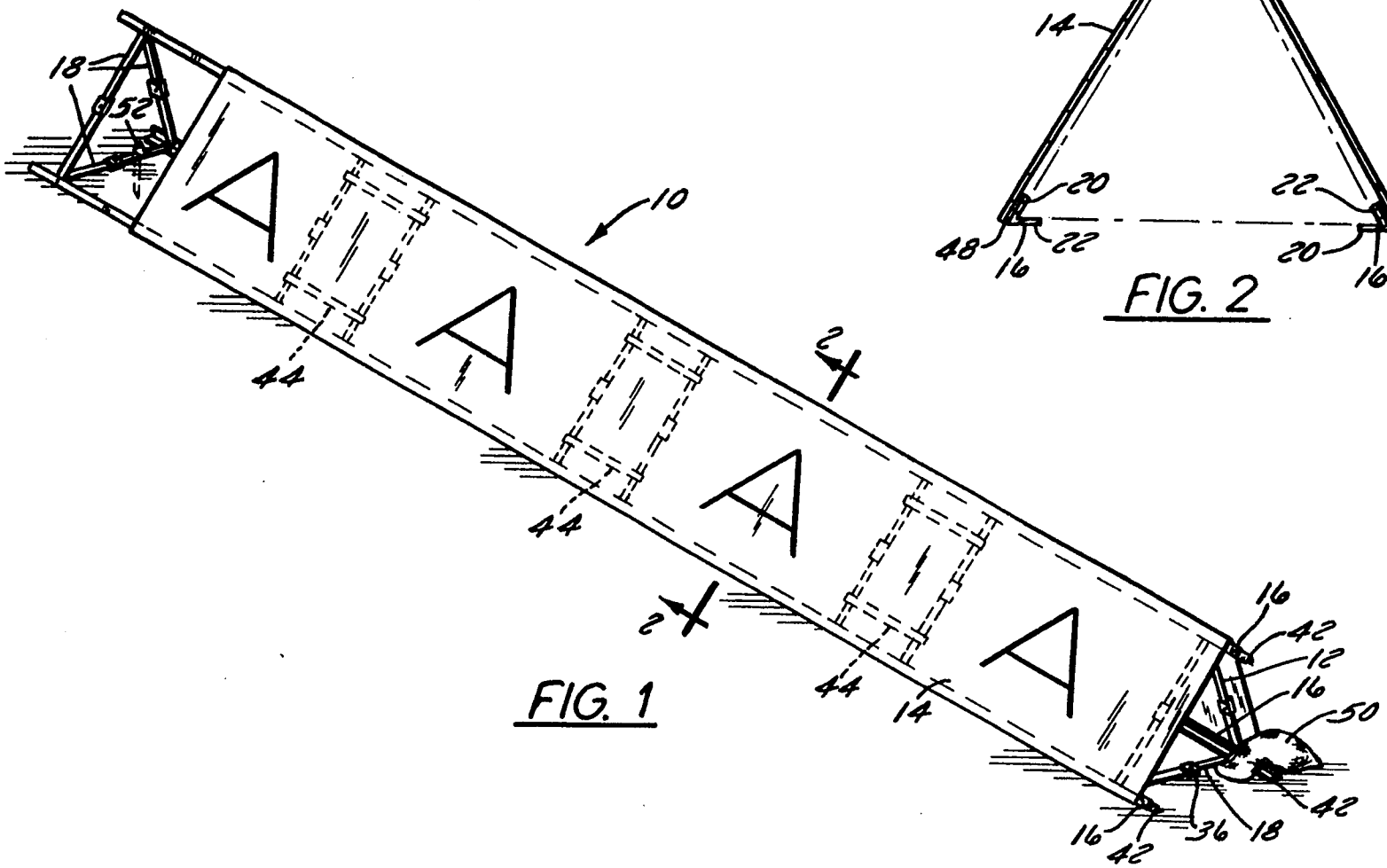
FIG. 1 a perspective view of a sign made in accordance with the present invention and including four sign frames connected together at their ends, with a single flexible sign cover draped over the four frames.
Figure 5:
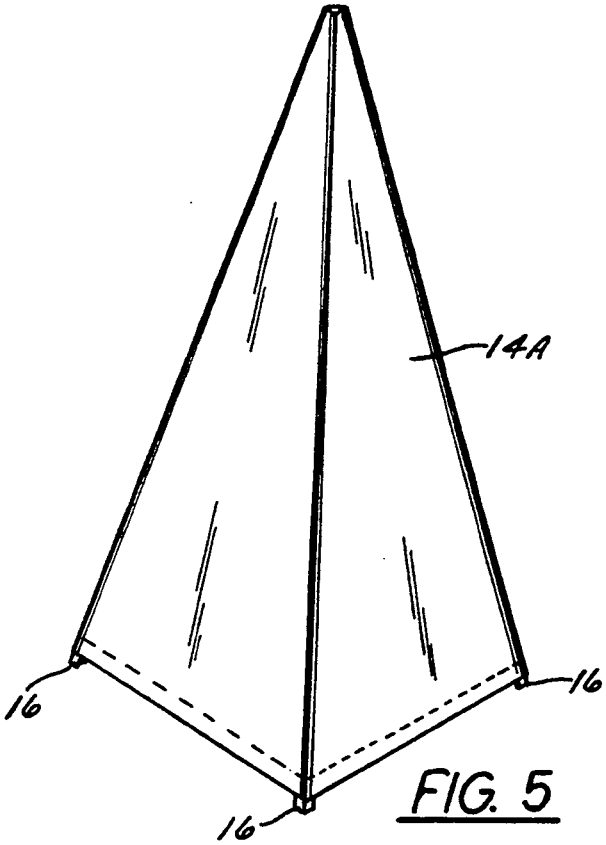
FIG. 5 is a perspective view of the sign frame of FIG. 4 and including a flexible sign covering draped over the frame.
Figure 6:
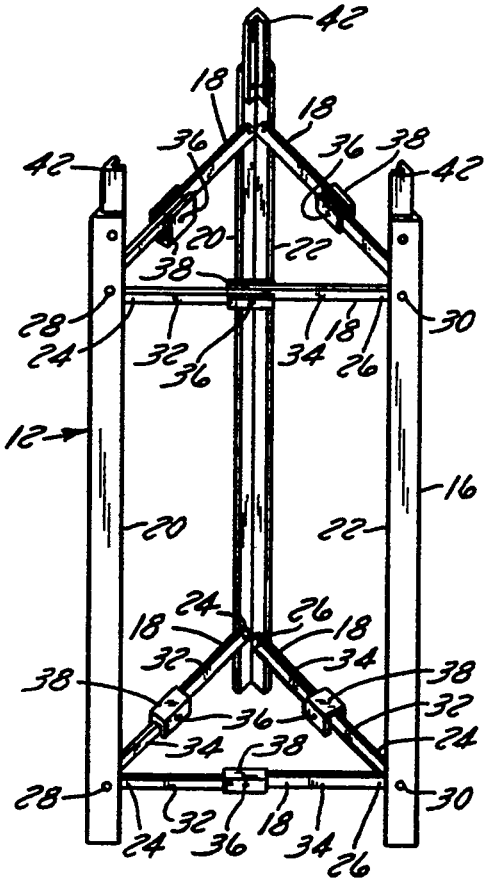
FIG. 6 is a perspective view of one of the sign frames of FIG. 1 standing vertically as a kiosk.

As can be seen best in FIG. 6, each of the signs 10 is made up of three straight, elongated rigid members 16 and a plurality of collapsible members 18 interconnecting the rigid members 16. The preferred embodiment has three of the elongated rigid members 16, but more rigid members could be used. If more rigid members were used, the cross-sectional shape of the sign frame might be a rectangle, a pentagon, a hexagon, or other shapes. Each adjacent pair of elongated members 16 defines a plane, so that, in this embodiment, three different planes are defined by the three elongated members 16. The flexible covering 14 then lies in the plane defined by the adjacent elongated members 16 when the covering is draped over the frame 12, as shown in FIGS. 1, 2, and 5. The elongated rigid members 16 are preferably made of aluminum, but other materials could also be used, preferably selecting materials which are strong and lightweight. In the preferred embodiment, each of the elongated members 16 is five feet long.

Figure 9:
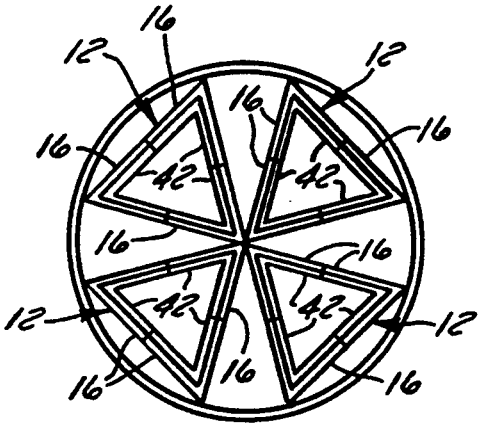
FIG. 9 an end view of the collapsed sign frames and shipping tube of FIG. 8.
Figure 10:
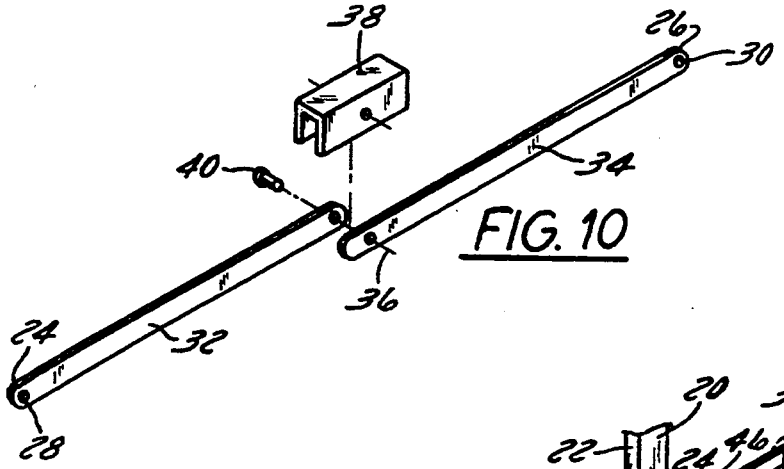
FIG. 10 is an exploded perspective view of two connector members and a stop from the sign of FIG. 1.

The elongated, rigid members 16 have an L-shaped cross-section, forming first and second leg portions 20, 22. The width of each of the leg portions is 1.25 inches, and this is referred to as the maximum width of each leg. In the present embodiment, the angle between the leg portions 20, 22 of each elongated rigid member 16 is 60°, so that the total of the three angles is 180°, as required to form a triangle. It would be possible for the angles to be 30°, 60° and 90° or other combinations of angles, as long as the total for the three elongated members is 180°. If four elongated, rigid members were used, the angles would have to add to 360° in order to form a rectangular or rhomboid cross-section. If more rigid members were used, the angles between the elongated members would be whatever is necessary to form a closed shape. The L-shaped cross-sections of the rigid members 16 are best shown in FIGS. 2 and 9.

Figure 8:
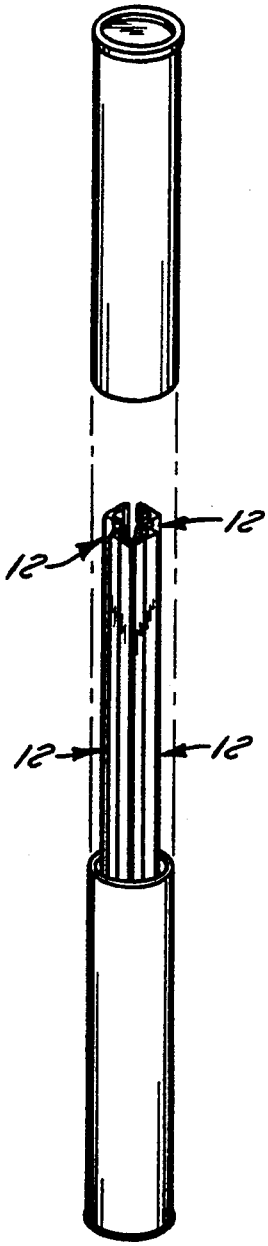
FIG. 8 is a perspective view of four of the collapsed sign frames of FIG. 7 in a shipping tube.
Figure 7:
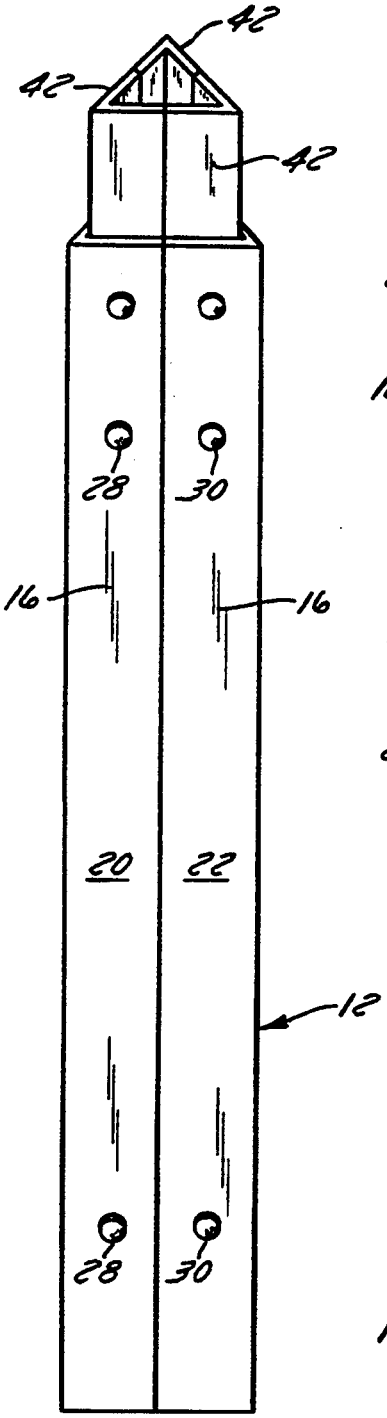
FIG. 7 is a perspective view of the sign frame of FIG. 6 in the collapsed position.

Each of the collapsible members 18 is two feet long and has first and second ends 24, 26, with the first end 24 of each collapsible member 18 pivotably connected to the inside of the first leg portion 20 of one of the rigid members 16 at the pivot point 28, and the second end 26 of each collapsible member 18 connected to the second leg portion 22 of the next adjacent rigid member 16 at the pivot point 30. When the collapsible members 18 are completely extended, as shown in FIGS. 1–3, 6, and 12, the rigid members 16 are parallel to each other and two feet apart from each other, and, when the collapsible members 18 are completely collapsed, as shown in FIGS. 7–9, the elongated, rigid members 16 are parallel to each other. The angles between the rigid members 16 remain the same in the completely extended and completely collapsed positions. In other words, in the embodiment shown here, the 60° angles between the elongated members remains the same, whether the sign frames are extended or collapsed, and the cross-sectional shape of the sign frame remains triangular at all times.

Each of the collapsible members is made up of two legs 32, 34, which are connected together at an internal pivot point 36. A stop 38 is mounted over the two legs 32, 34 at the internal pivot point 36, and a pin 40 extends through the legs 32, 34 and through the stop 38 at the internal pivot point 36. The stop 38 has a U-shaped cross-section and is mounted so as to permit the legs 32, 34 to pivot relative to each other 180° in one direction and to limit the relative motion in the other direction. This helps keep the sign frame rigid when it is erected.

To move from the collapsed position, shown in FIG. 7, to the extended position, shown in FIGS. 1–3, 6 and 12, the elongated members 16 are pulled apart, causing the ends 24, 26 of each collapsible member 16 to pivot away from each other about the internal pivot point 36. As shown in FIG. 13, the collapsible members 18 are partially extended, with the ends 24, 26 about 120° apart. When the angle reaches 180° (a straight line), the collapsible members are fully extended.

Figure 3:
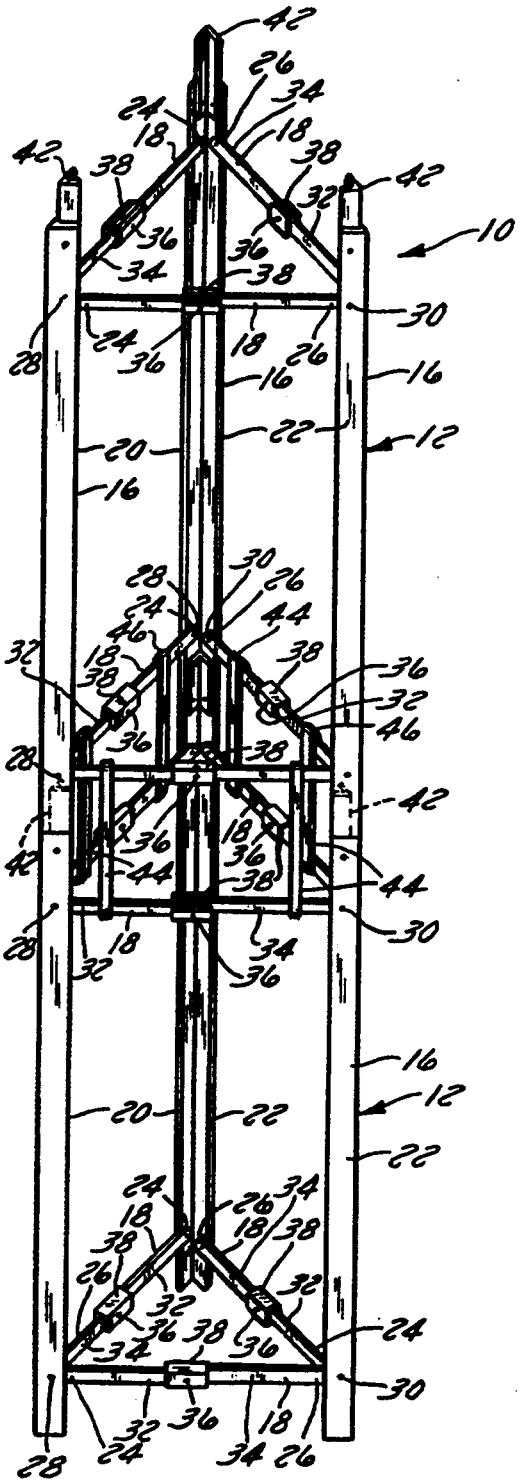
FIG. 3 is a perspective view of two of the sign frames of FIG. 1 connected together and standing vertically.
Figure 12:
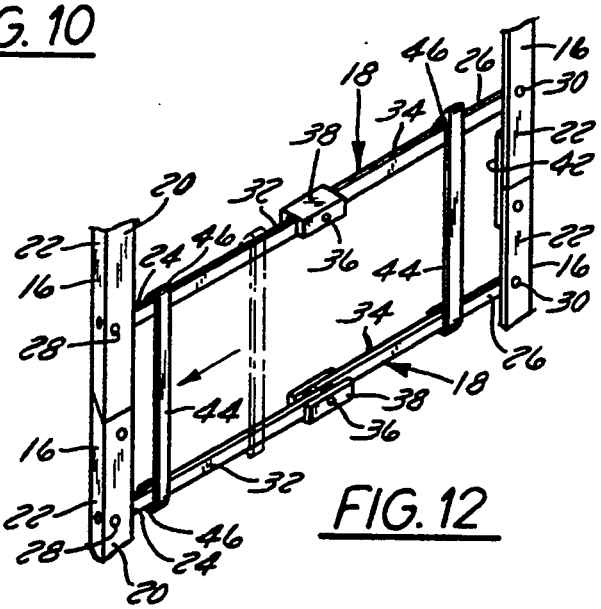
FIG. 12 is an enlarged, broken-away perspective view of the joint between two of the sign frames of FIG. 3.
Figure 11:
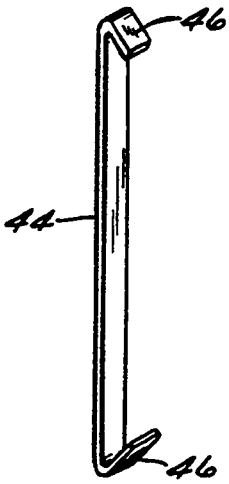
FIG. 11 is a perspective view of one of the hooked connectors of FIG. 1.
Figure 13:
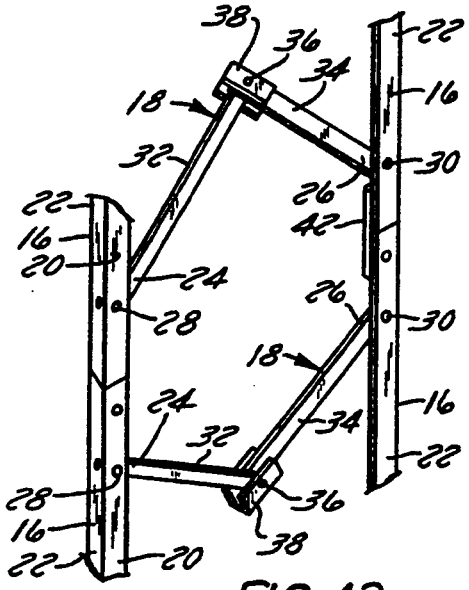
FIG. 13 is a perspective view of the portion of the sign frames of FIG. 12 as the sign frames are being collapsed.

As shown in FIGS. 1, 3, and 12, two or more individual sign frames 12 can be connected together to form a long sign frame. Connecting two sign frames together is a very simple matter. As shown best in FIGS. 6 and 7, each of the rigid members 16 has a projection 42 at one end. The projection 42 conforms to the inner surface of its respective rigid member and is fixed to the inner surface of that rigid member. In order to connect two sign frames 12 together, the collapsible members 18 are fully extended, and then the frames are slid together, with the projections 42 at one end of one frame sliding inside the respective rigid members 16 of the adjacent frame. Then, six substantially flat, elongated connector pieces 44, having hooks 46 at both ends, are used to connect the two sign frames together as shown best in FIG. 12.

The stops 38 permit the collapsible members 18 to bow slightly toward each other in the area of the internal pivot points 36, so that the collapsible members 18 are closer to each other at the center than at the ends. The connectors 44 are sized so that they can readily fit over the collapsible members 18 near the center and then be slid toward the end of the collapsible members 18 until there is a tight fit between the hooks 46 on the ends of the connector members and the collapsible members 18. In this way, the connector members apply a constant force tending to pull the collapsible members together, and the stops 38 resist that force, preventing the collapsible members from collapsing toward each other. With the projections 42 fitting into their respective rigid members and the connectors 44 in place, the sign frames are very rigid. As shown in FIG. 3, two connectors 44 are used on each face of the sign frame, for a total of six connectors at each joint. To connect four sign frames together, as shown in FIG. 1, would require eighteen connectors.

Once the sign frames 12 have been connected together, a flexible sign cover 14 is draped over the frames 12 and is fastened to the frames 12, as shown in FIG. 1. In the preferred embodiment, a hook and loop type of fastener (i.e. Velcro brand) is used, with a strip of the fastener 48 attached to one of the rigid members 16 in the front and a strip of the fastener 48 attached to one of the rigid members 16 in the back, and corresponding fastener strips 48 attached to the back side of the flexible sign cover 14, as seen best in FIG. 2. Artwork and lettering are shown on the front of the flexible sign cover material in FIG. 1.

The flexible cover 14 can be made of cloth, plastic, or other flexible material that can be folded or rolled up to fit into a shipping tube.

Figure 4:
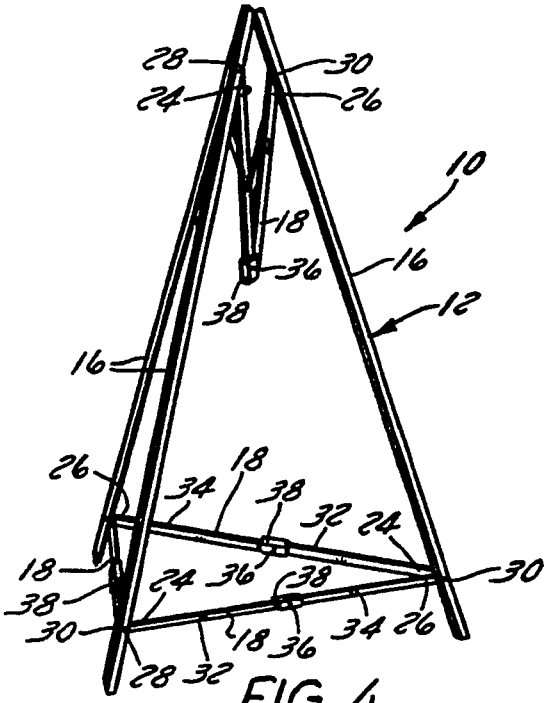
FIG. 4 is a perspective view of one of the sign frames of FIG. 1 formed into a teepee shape.

The preferred manner of using the sign of the present invention is shown in FIG. 1, in which two or more of the sign frames 12 are connected together and lie down horizontally on the ground. Connecting two of the frames together provides rigidity that would not be present if only a single sign frame were lying down horizontally. If a single frame were to be used in the horizontal position, it would be necessary to add a support (not shown) to keep the frame rigid. Two sign frames would probably not be used vertically as shown in FIG. 3, because they would tend to be top-heavy and fall over, but FIG. 3 is a good view of the two sign frames connected together end-to-end, as they would be connected when used in the horizontal position. A single frame could be used vertically as shown in FIG. 6, with all the rigid members 16 parallel to each other, forming a type of kiosk, in which case the flexible covering would preferably have a cylindrical shape (not shown). A single frame could be used as shown in FIGS. 4 and 5, with the collapsible members at one end extended and the collapsible members at the other end partially collapsed until the upper ends of the elongated, rigid members 16 contact each other to form a teepee shape. In that case, the flexible covering 14A would be formed in the same teepee shape and would then be draped over the teepee frame, as shown in FIG. 5.

When the signs are used in the horizontal position, as in FIG. 1, two of the elongated, rigid members 16 lie horizontally on the ground. When the signs are used in the vertical position, as in FIGS. 4 and 6, three elongated, rigid members 16 contact the ground. A self-supporting structure results in the horizontal position and in the kiosk and teepee vertical positions. If these signs are to be used in a windy location, where there is a risk of their blowing over, a weight such as the sandbag 50 shown in FIG. 1 can be placed over the rigid members 16 or collapsible members 18, or stakes can be hammered into the ground and fastened to the sign frame by hooking over the frame (as shown at 52 in FIG. 1) or by tying to the frame.

In order to collapse the frame, the connectors 44 are removed by sliding them toward the internal pivot points 36 and then lifting them off of the collapsible members 18. Then, the sign frames 12 can all be collapsed together, as shown in FIG. 13, or the frames 12 can be separated from each other first and then collapsed. In order to collapse, the ends 24, 26 of each of the collapsible members pivot toward each other about their respective internal pivot point 36 until the ends 24, 26 are adjacent to each other, and all of the collapsible members 18 are collapsed. Since the ends 24, 26 of the collapsible members 18 are connected to the inside surfaces of the rigid members 16, the collapsible members 18 end up lying inside the elongated rigid members 16. In the collapsed position, adjacent rigid members 16 lie very close to or touch each other, forming an elongated member having a closed, triangular cross-section shape, with the collapsible members inside the triangle.

In the preferred embodiment, each of the leg portions 20, 22 of the rigid members 16 is one-and-one-quarter inches wide (the maximum width of each elongated member) and five feet long. When collapsed, each frame has a triangular cross-section, with the maximum dimension (maximum diameter) of that triangular cross-section being twice the maximum width of the elongated members. The height of the triangular cross-section is 2.16 inches, so four of the frames readily fit into a six-inch diameter tube, as shown in FIG. 9. The tube is slightly longer than five feet to accommodate the projections 42. The only loose parts are the connectors 44, and a few extra connectors 44 can be dropped into each shipping tube in case any get lost.

So, when the event is over, the shipping tubes containing the frames and the shipping tubes containing the flexible sign coverings are shipped to the next location by UPS or other common carrier. A person meets them at the next location and can easily unload and set up by himself. If sandbags are used, they can be rented locally. When the second event is over, that one person can readily take down the signs by himself, put them back into their shipping tubes, and send them on to the next event.

It will be obvious to those skilled in the art that modifications may be made to the embodiment described above without departing from the scope of the present invention.

What is claimed is:

1. A portable sign, comprising:

a sign frame, including at least three elongated members each having a maximum width; and a plurality of collapsible members interconnecting said elongated members in such a way that, when said collapsible members are extended, said elongated members are parallel to each other and each adjacent pair of elongated members defines a plane, such that said at least three elongated members defines at least three different planes, and when said collapsible members are collapsed, said elongated members are parallel to each other and lie adjacent to each other such that the collapsed sign frame has a narrow, elongated shape with a maximum cross-sectional dimension which is less than the total of the maximum widths of each of the elongated members, wherein said sign, with the collapsible members in the extended position, is self-supporting, when said parallel elongated members are resting on the ground in a vertical position.

2. A portable sign as recited in claim 1, wherein said sign, with the collapsible members in the collapsed position, has its outside dimensions defined by said parallel elongated members, with said collapsible members lying inside a space defined by said parallel members.

3. A portable sign as recited in claim 2, wherein said elongated members have an L-shaped cross-section.

4. A portable sign as recited in claim 1, wherein the cross-section area of said sign with the collapsible members in the collapsed position occupies a maximum of one-fourth of the cross-sectional area of a six-inch diameter circle, such that four of said portable signs can be shipped in a six-inch diameter shipping tube having a length slightly longer than the longest of the rigid members.

5. A portable sign, comprising:

a sign frame, including at least three elongated members each having a maximum width; and a plurality of collapsible members interconnecting said elongated members in such a way that, when said collapsible members are extending, said elongated members are parallel to each other and each adjacent pair of elongated members defines a plane, such that said at least three elongated members define at least three different planes, and when said collapsible members are collapsed, said elongated members are parallel to each other and lie adjacent to each other such that the collapsed sign frame has a narrow, elongated shape with a maximum cross-sectional dimension which is less than the total of the maximum widths of each of the elongated members, and further comprising a flexible cover portion, which fits over said sign frame and includes means for attaching the cover to said sign frame, wherein said flexible cover portion can be folded or rolled up to fit into a shipping tube.

6. A portable sign, comprising:

at least three elongated members of approximately equal length; and a plurality of collapsible members connected at their ends to the elongated members, each of said collapsible connecting members defining a collapsed position and an extended position;

wherein, when all the collapsible members are in the extended position, the elongated members are parallel to each other, and define at least three different planes, and, when all the collapsible members are in the collapsed position, the rigid members are parallel to each other with the angles between the elongated members being the same in the extended and collapsed positions but with the distances between the elongated members being large in the extended position and small or zero in the collapsed position.

7. A portable sign as recited in claim 6, wherein said parallel, elongated members have an L-shaped cross-section, defining an outside surface and an inside surface, and, when all the collapsible members are in the collapsed position, the outside surfaces of said elongated members define a substantially closed-shaped cross-section, with the collapsible members lying inside said closed shape.

8. A portable sign as recited in claim 7, wherein said portable sign is free-standing when the collapsible members are extended, with at least two of said parallel elongated members lying horizontally on the ground.

9. A portable sign as recited in claim 8, and further comprising a flexible covering material which is made to drape over said elongated members and said collapsible members and including means for fixing said flexible covering material to said members.

10. A portable sign as recited in claim 6, wherein, when the collapsible members at one end of said sign are partially collapsed and the collapsible members on the other end are extended, the sign forms a cone-type shape, in which case the sign is free-standing, with one end of the elongated members contacting the ground.

11. A portable sign as recited in claim 10, and further comprising a flexible covering material which is made in a cone-type shape to fit over the elongated members and the connecting members.

12. A portable sign as recited in claim 6, wherein each of said collapsible members is pivotably connected at one end to one of said elongated members and at the other end to another of said elongated members.

13. A portable sign as recited in claim 12, wherein each of said collapsible members is made in at least two pieces, which are pivotably connected to each other at a pivot point, such that, in order to collapse, the two pieces rotate relative to each other, with the two ends moving toward each other, and, in order to extend, the two pieces rotate relative to each other with the two ends moving away from each other.

14. A portable sign as recited in claim 13, and further comprising a stop at the pivot point of each of said collapsible members, which prevents the two pieces of the collapsible members from pivoting more than 180° relative to each other.

15. A portable sign, comprising:

three elongated members, each having an L-shaped cross section so that each elongated member has a first leg portion and a second leg portion, with each of the elongated members defining an outer surface and an inner surface;

a plurality of collapsible members, each of said collapsible members pivotably fastened at one end to the inside of a first leg portion of one elongated member and at the other end to the inside of a second leg portion of the adjacent elongated member, each of said collapsible members defining an internal pivot point, so that, in order to extend or collapse, the ends of each collapsible member pivot away from each other or toward each other about the internal pivot point;

wherein, when said collapsible members are extended, said elongated members are parallel to each other, and, when said collapsible members are collapsed, said elongated members are parallel to each other.

16. A portable sign, as recited in claim 15, and further comprising a stop located near the internal pivot point of each collapsible member, said stop being fastened to the collapsible member and mounted so as to prevent the collapsible members from rotating substantially more than 180° relative to each other about the internal pivot point.

17. At least two portable signs, each of said portable signs as recited in claim 15, and further comprising a plurality of attachment members, each of said attachment members comprising a substantially flat, elongated piece, having two ends and having a hook at both ends, such that, when the corresponding elongated members of the two portable signs are aligned end-to-end with each other, the hook at one end of said elongated piece can be hooked around one of the collapsible members of one portable sign, while the hook at the other end of said elongated piece is hooked around one of the collapsible members of the other portable sign, thereby locking the portable signs together, making the signs rigid, and providing a continuous, flat face for supporting a flexible sign covering.

* * * * *

UNITED STATES PATENT AND TRADEMARK OFFICE

CERTIFICATE OF CORRECTION

PATENT NO. : 5,347,737

DATED : September 20, 1994

INVENTOR(S) : Clarence J. Theobald, III

It is certified that error appears in the above-indentified patent and that said Letters Patent is hereby corrected as shown below:

In claim 2, column 6, line 11
insert --elongated-- between "parallel" and "members".

In claim 4, column 6, line 15
"cross-section" should read --cross-sectional--.

Signed and Sealed this

Eighth Day of November, 1994

*Attest:*

Bruce Lehman

BRUCE LEHMAN

*Attesting Officer*

*Commissioner of Patents and Trademarks*